US011735847B2

(12) United States Patent
Ni et al.

(10) Patent No.: US 11,735,847 B2
(45) Date of Patent: Aug. 22, 2023

(54) CONNECTOR ASSEMBLY

(71) Applicant: Tyco Electronics (Shanghai) Co. Ltd., Shanghai (CN)

(72) Inventors: Hongjian (Neil) Ni, Shanghai (CN); Xinjie (David) Zhang, Kunshan (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 51 days.

(21) Appl. No.: 17/404,316

(22) Filed: Aug. 17, 2021

(65) Prior Publication Data

US 2022/0059956 A1 Feb. 24, 2022

(30) Foreign Application Priority Data

Aug. 19, 2020 (CN) ..... 202010837328.4
Aug. 28, 2020 (CN) ..... 202010887189.6

(51) Int. Cl.
*H01R 12/72* (2011.01)
*H01R 12/70* (2011.01)

(52) U.S. Cl.
CPC ..... *H01R 12/721* (2013.01); *H01R 12/707* (2013.01)

(58) Field of Classification Search
CPC ..... H01R 12/721; H01R 12/707
USPC ..... 439/62
See application file for complete search history.

(56) References Cited

U.S. PATENT DOCUMENTS 3,902,776 A * 9/1975 Williams ..... H01R 12/718 439/62
4,687,267 A * 8/1987 Header ..... H01R 12/725 439/62
4,693,408 A * 9/1987 Dines ..... B23K 1/012 228/49.5
4,992,052 A * 2/1991 Verhoeven ..... H01R 12/721 439/62
6,746,280 B1 * 6/2004 Lu ..... H01R 24/00 439/945
9,166,320 B1 * 10/2015 Herring ..... H01R 12/79
9,373,915 B1 * 6/2016 Schulz ..... H01R 13/6461
9,431,736 B2 * 8/2016 Chen ..... H01R 12/79
9,466,925 B2 * 10/2016 Rost ..... H01R 13/65912
2004/0157492 A1 * 8/2004 Wu ..... H01R 13/6589 439/497
2014/0206230 A1 * 7/2014 Rost ..... H01R 13/65912 439/607.01

(Continued)

FOREIGN PATENT DOCUMENTS

CN 1505784 A * 6/2004 ..... G06F 1/184
CN 201029182 Y * 2/2008 ..... H01R 13/5845

(Continued)

*Primary Examiner* — Peter G Leigh
(74) *Attorney, Agent, or Firm* — Barley Snyder

(57) ABSTRACT

A connector assembly comprises a circuit board having a front side and a back side, with a connector installed on the front side of the circuit board. A plurality of first welding pads are formed on the front side of the circuit board, and a plurality of second welding pads are formed on the back side of the circuit board. A plurality of wires are connected to the circuit board, with a first portion thereof connected to the first welding pads and a second portion thereof connected to the second welding pads. Each of the plurality of wires extend away from the circuit board from above the front side of the circuit board.

15 Claims, 5 Drawing Sheets

(56) References Cited

U.S. PATENT DOCUMENTS

| | | | | |
|---|---|---|---|---|
| 2016/0006152 | A1* | 1/2016 | Chih-jung | H01R 12/732<br>439/493 |
| 2016/0365673 | A1* | 12/2016 | Liang | H01R 13/6469 |

FOREIGN PATENT DOCUMENTS

| | | | | |
|---|---|---|---|---|
| CN | 203733969 | U * | 7/2014 | |
| CN | 104348051 | A * | 2/2015 | H01R 12/65 |
| CN | 207651703 | U * | 7/2018 | |
| FR | 2783621 | A1 * | 3/2000 | G06K 7/0013 |

* cited by examiner

CONNECTOR ASSEMBLY

CROSS-REFERENCE TO RELATED APPLICATIONS

This application claims the priority benefit of Chinese Patent Application No. 202010887189.6 filed on Aug. 28, 2020, and Chinese Patent Application No. 202010837328.4 filed on Aug. 19, 2020, the whole disclosures of which are incorporated herein by reference.

FIELD OF THE INVENTION

The present disclosure relates to a connector assembly, and more specifically, to a wiring assembly for a connector mounted to a circuit board.

BACKGROUND

Connectors are often required to be joined with associated wires via a circuit board. Generally, the connector is installed on a front or top side of the circuit board, and the wires are connected from a back or bottom side of the circuit board, or otherwise exit from the underside of the circuit board. This results in the need to leave a relatively large space under the circuit board to accommodate the wires. However, as available space becomes smaller and smaller due to the requirements of product miniaturization, excessive bending or other stress on the bottom-routed wires and their associated connections occurs, reducing the quality and/or reliability of the connector assembly.

SUMMARY

A connector assembly according to an embodiment of the present disclosure comprises a circuit board having a front side and a back side, with a connector installed on the front side of the circuit board. A plurality of first welding pads are formed on the front side of the circuit board, and a plurality of second welding pads are formed on the back side of the circuit board. A plurality of wires are connected to the circuit board, with a first portion thereof connected to the first welding pads and a second portion thereof connected to the second welding pads. Each of the plurality of wires extend away from the circuit board from above the front side of the circuit board.

BRIEF DESCRIPTION OF THE DRAWINGS

The invention will now be described by way of example with reference to the accompanying Figures, of which.

DETAILED DESCRIPTION OF THE EMBODIMENTS

Figure 1:
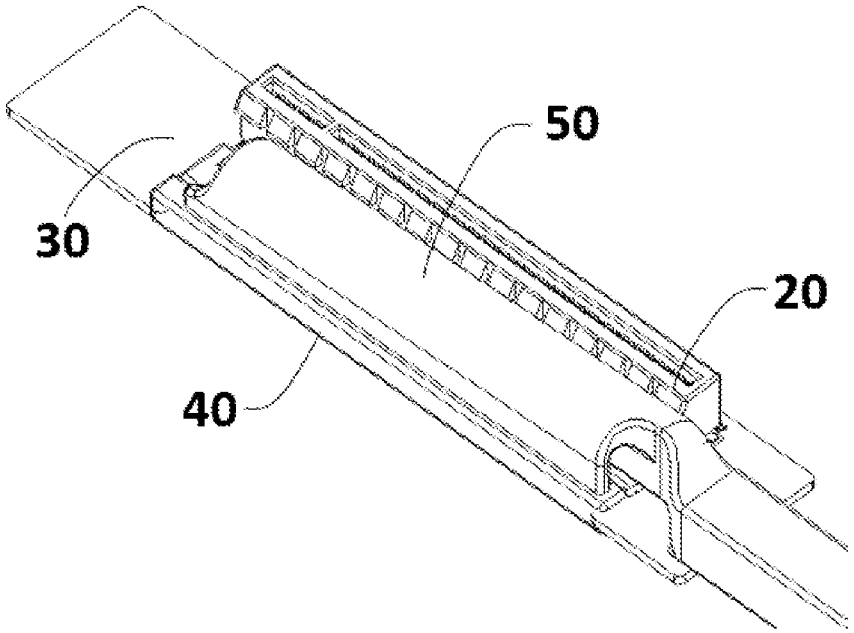
FIG. 1 shows a schematic perspective diagram of a connector assembly according to an exemplary embodiment of the present disclosure when viewed from one direction.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector assembly includes a circuit board having a front side and a back side, a connector installed on the front side of the circuit board, and a plurality of wires connected to the circuit board and electrically connected to the connector via the circuit board. The plurality of wires extend away from the circuit board from above the front side.

Figure 2:
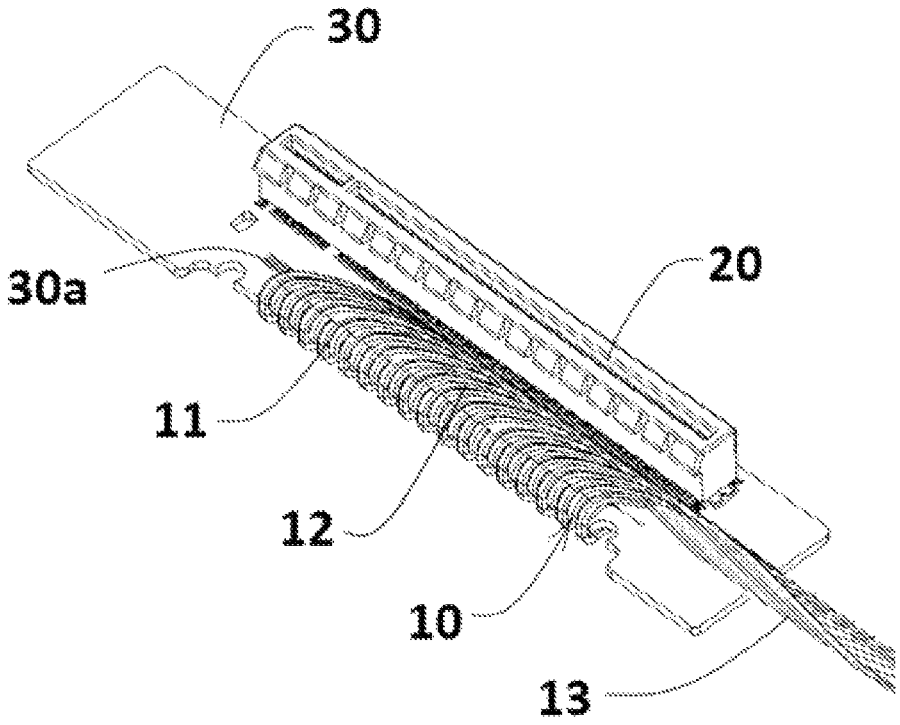
FIG. 2 shows a schematic perspective diagram of the connector assembly shown in FIG. 1, in which an insulation covering body and an insulation wrapping layer are removed.
Figure 3:
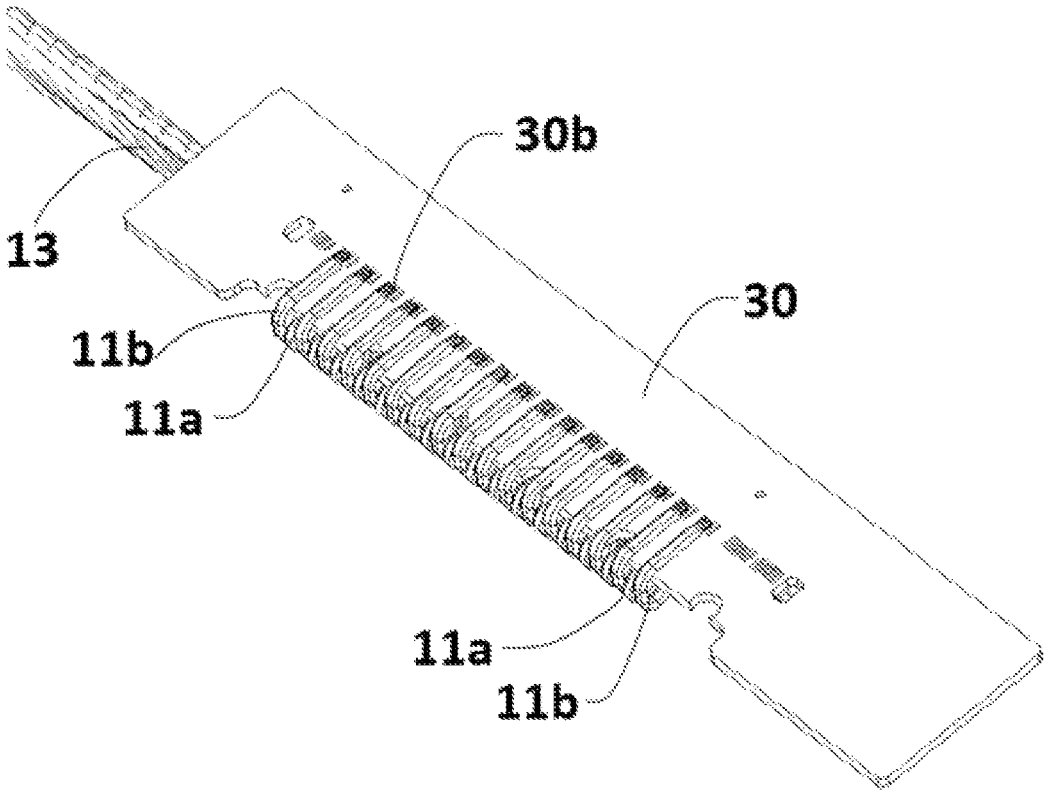
FIG. 3 shows a schematic perspective diagram of the connector assembly shown in FIG. 1 when viewed from a back side, in which the insulation covering body and the insulation wrapping layer are removed.

FIG. 1 shows a schematic perspective diagram of a connector assembly according to an exemplary embodiment of the present disclosure when viewed from one direction. FIG. 2 shows a schematic perspective diagram of the connector assembly shown in FIG. 1, in which an insulation covering body 40 and an insulation wrapping layer 50 are removed. FIG. 3 shows a schematic perspective diagram of the connector assembly shown in FIG. 1 when viewed from a back side, in which the insulation covering body 40 and the insulation wrapping layer 50 are removed. As shown in FIGS. 1-3, the connector assembly according to an embodiment of the present disclosure includes a plurality of wires 10, a connector 20 and a circuit board 30. The circuit board 30 has a front side and a back side. The connector 20 is installed on the front side of the circuit board 30, and the plurality of wires 10 are connected to the circuit board 30 and electrically connected to the connector 20 via the circuit board 30.

The plurality of wires 10 extend away from, or exit, the circuit board 30 from above the front side of the circuit board. More specifically, each of the plurality of wires 10 includes a welding portion 11 adapted to be welded to the circuit board 30 and an extension portion 12, 13 connected to the welding portion 11 and located above the front side of the circuit board 30. As the connector 20 is installed on the front side of the circuit board 30, there is a larger available space above the front side of the circuit board 30. By routing the wires 10 from above the board, no space is taken up on the underside of the board, nor do the wires need to be excessively bent or stressed. This not only reduces the size of the connector assembly, but also improves its quality and reliability.

Figure 4:
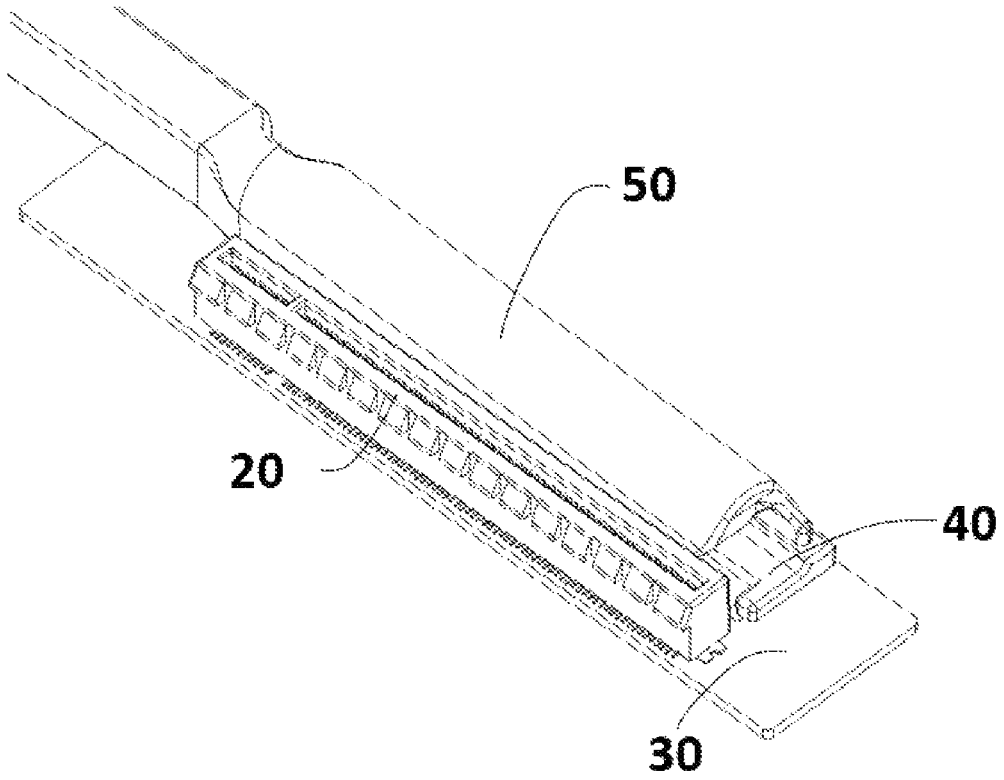
FIG. 4 shows a schematic perspective diagram of the connector assembly according to an exemplary embodiment of the present disclosure when viewed from another direction.
Figure 5:
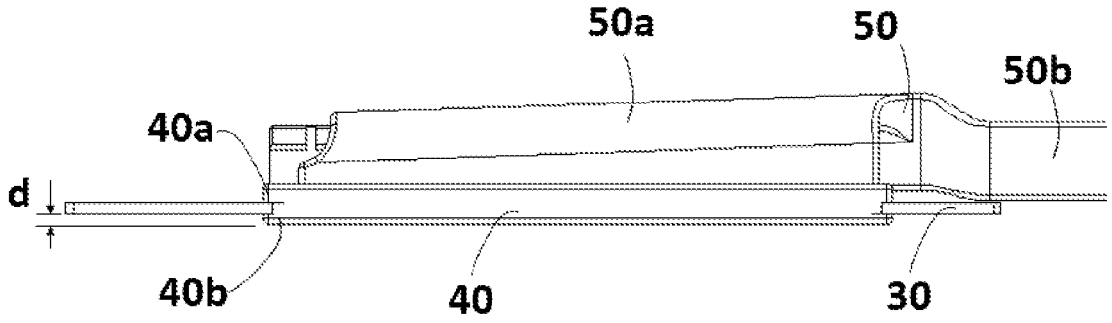
FIG. 5 shows a schematic perspective view of the connector assembly according to an exemplary embodiment of the present disclosure when viewed from a side.

FIG. 4 shows a schematic perspective diagram of the connector assembly according to an exemplary embodiment of the present disclosure when viewed from another direction. FIG. 5 shows a schematic perspective view of the connector assembly according to an exemplary embodiment of the present disclosure when viewed from a side. As shown in FIGS. 1-5, a row of first welding pads 30*a* is formed on the front side of the circuit board 30, and a row of second welding pads 30*b* is formed on the back side of the circuit board 30. The welding portions 11 of the plurality of wires 10 are welded to the first welding pads 30*a* and the second welding pads 30*b* in an alternating manner, respectively.

The welding portions 11 of the plurality of wires 10 welded to the first welding pads 30*a* are arranged in a row on the front side of the circuit board 30 and define a row of front welding portions 11*a*. The welding portions 11 of the plurality of wires 10 welded to the second welding pads 30*b* are arranged in a row on the back side of the circuit board 30 and define a row of back welding portions 11*b*. The back welding portions 11*b* are wrap around an edge of the circuit board 30 to the front side in an accommodating recess or notch formed in the edge of the circuit board.

The connector assembly further includes an insulation covering body 40 molded on the circuit board 30 and covering the welding portions 11 of the plurality of wires 10. The insulation covering body 40 covers an edge portion of one side of the circuit board 30 including the notch or recess, the row of front welding portions 11*a* and the row of back welding portions 11*b*. The thickness d of a portion 40*b* of the insulation covering body 40 located on the back side of the circuit board 30 is less than or equal to that of the circuit board 30. In this way, the space required under the back side of the circuit board 30 can be significantly reduced.

The thickness of a portion 40*a* of the insulation covering body 40 located on the front side of the circuit board 30 is greater than the thickness d of the portion 40*b* of the insulation covering body 40 located on the back side of the circuit board 30. As the space above the front side of the circuit board 30 is relatively large, the thickness of the portion 40*a* of the insulating coating body 40 located on the front side of the circuit board 30 can be appropriately increased to improve the strength of the insulating coating body 40.

The extension portion 12, 13 of each wire 10 includes a straight extension segment 13 and a curved extension segment 12 connected between the welding portion 11 and the straight extension segment 13. The straight extension segment 13 extends along a longitudinal direction of the circuit board 30 and leaves or exits from the circuit board 30, and the welding portion 11 extends along a transverse direction of the circuit board 30. The connector assembly further includes an insulation wrapping layer 50 wrapped on the extension portions 12, 13 of the plurality of wires 10. The insulation wrapping layer 50 includes a first segment 50*a* wrapped on the curved extension segments 12 of the plurality of wires 10 and a second segment 50*b* wrapped on the straight extension segments 13 of the plurality of wires 10. The insulation wrapping layer 50 may be an insulating tape wrapped on the extension portions 12, 13 of the plurality of wires 10.

In the illustrated embodiment, the connector 20 includes an insulation body and a plurality of terminals installed in slots of the insulation body, the plurality of terminals being welded to the circuit board 30 and electrically connected to the plurality of wires 10 via the circuit board 30. The connector 20 may be a card connector adapted for insertion of an electronic card.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector assembly, comprising:

a circuit board having a front side and a back side;

a connector installed on the front side of the circuit board; and a plurality of wires connected to the circuit board and electrically connected to the connector via the circuit board, the plurality of wires extending from the front side of circuit, each wire includes a welding portion welded to the circuit board and an extension portion connected to the welding portion and located above the front side of the circuit board that wraps from the back side to the front side within a recess formed in an edge of the circuit board; and an insulation covering body is molded on the circuit board and covers the recess and the welding portions of the plurality of wires.

2. The connector assembly according to claim 1, wherein a row of first welding pads is formed on the front side of the circuit board, a row of second welding pads is formed on the back side of the circuit board, and the welding portions of the plurality of wires are welded to the first welding pads and the second welding pads in an alternating manner, respectively.

3. The connector assembly according to claim 2, wherein:

the welding portions of the plurality of wires welded to the first welding pads are arranged in a row on the front side of the circuit board and define front welding portions; and the welding portions of the plurality of wires welded to the second welding pads are arranged in a row on the back side of the circuit board and define back welding portions.

4. The connector assembly according to claim 3, wherein the insulation covering body covers an edge portion of one side of the circuit board, the row of front welding portions and the row of back welding portions.

5. The connector assembly according to claim 4, wherein a thickness of a portion of the insulation covering body located on the back side of the circuit board is less than or equal to a thickness of the circuit board.

6. The connector assembly according to claim 5, wherein a thickness of a portion of the insulation covering body located on the front side of the circuit board is greater than a thickness of the portion of the insulation covering body located on the back side of the circuit board.

7. The connector assembly according to claim 1, further comprising an insulation wrapping layer wrapped on the extension portions of the plurality of wires.

8. The connector assembly according to claim 7, wherein the extension portion of each wire comprises a straight extension segment and a curved extension segment connected between the welding portion and the straight extension segment.

9. The connector assembly according to claim 8, wherein the straight extension segment extends along a longitudinal direction of the circuit board and exits the circuit board, and the welding portion extends along a transverse direction of the circuit board.

10. The connector assembly according to claim 8, wherein the insulation wrapping layer includes a first segment wrapped on the curved extension segments of the plurality of wires and a second segment wrapped on the straight extension segments of the plurality of wires.

11. The connector assembly according to claim 8, wherein the insulation wrapping layer is an insulating tape wrapped on the extension portions of the plurality of wires.

12. The connector assembly according to claim 1, wherein the connector includes a plurality of terminals installed in slots of the insulation body, the plurality of terminals being welded to the circuit board and electrically connected to the plurality of wires via the circuit board.

13. The connector assembly according to claim 12, wherein the connector is a card connector adapted for insertion of an electronic card.

14. A connector assembly, comprising:

a circuit board having a front side and a back side;

a connector installed on the front side of the circuit board;

a plurality of first welding pads formed on the front side of the circuit board;

a plurality of second welding pads formed on the back side of the circuit board; and a plurality of wires connected to the circuit board, each wire comprises a welding portion welded to a respective one of the welding pads, and an extension portion connected to the welding portion and located above the front side of the circuit board, a first portion of the plurality of wires connected to the first welding pads and a second portion of the plurality of wires connected to the second welding pads, each of the plurality of wires extending away from the circuit board from above the front side of the circuit board, the plurality of first welding pads and the plurality of second welding pads are arranged in respective rows on the front and back side of the circuit board, and the welding portions of the second portion of the plurality of wires wrap from the back of the circuit board to the front of the circuit board within a recess formed in an edge of the circuit board, an insulation covering body is molded on the circuit board and covers the recess and the welding portions of the first and second portions of the plurality of wires.

15. The connector assembly according to claim 14, wherein the welding portions of the plurality of wires are welded to the first welding pads and the second welding pads in an alternating manner.

* * * * *